US010253601B2

(12) United States Patent
Saltykov et al.

(10) Patent No.: US 10,253,601 B2
(45) Date of Patent: Apr. 9, 2019

(54) DOWNHOLE ACOUSTIC DEVICE FOR TREATING THE BOTTOMHOLE REGIONS OF OIL AND GAS RESERVOIRS

(71) Applicant: OBSHHESTVO S OGRANICHENNOJ OTVETSTVENNOST'YU "ILMASONIK-NAUKA", Shchelkovo (RU)

(72) Inventors: Aleksandr Alekseevich Saltykov, Shchelkovo (RU); Yurij Alekseevich Saltykov, Moscow (RU); Darina Yur'evna Saltykova, Moscow (RU); Sergej Sergeevich Dement'ev, Shchelkovo (RU)

(73) Assignee: LIMITED LIABILITY COMPANY "ILMASONIK-SCIENCE", Moscow (RU)

( * ) Notice: Subject to any disclaimer, the term of this patent is extended or adjusted under 35 U.S.C. 154(b) by 91 days.

(21) Appl. No.: 15/373,973

(22) Filed: Dec. 9, 2016

(65) Prior Publication Data

US 2017/0089181 A1 Mar. 30, 2017

Related U.S. Application Data

(63) Continuation-in-part of application No. PCT/RU2014/000426, filed on Jun. 10, 2014.

(51) Int. Cl.

| | |
|---|---|
| ***E21B 43/25*** | (2006.01) |
| ***E21B 28/00*** | (2006.01) |
| ***E21B 43/00*** | (2006.01) |

(52) U.S. Cl.

CPC ..... *E21B 43/003* (2013.01); *E21B 28/00* (2013.01)

(58) Field of Classification Search

CPC ..... E21B 43/003; E21B 43/25; E21B 28/00

See application file for complete search history.

(56) References Cited

U.S. PATENT DOCUMENTS

| | | | | |
|---|---|---|---|---|
| 2,871,943 | A * | 2/1959 | Bodine, Jr. ..... | B01J 19/10 166/177.1 |
| 3,578,081 | A | 5/1971 | Bodine | |

(Continued)

FOREIGN PATENT DOCUMENTS

| | | | |
|---|---|---|---|
| RU | 2162519 | C2 | 1/2001 |
| RU | 2193651 | C2 | 11/2002 |
| RU | 2196217 | C2 | 1/2003 |
| RU | 2244946 | C1 | 1/2005 |
| RU | 2260688 | C1 | 9/2005 |
| RU | 2304214 | C1 | 8/2007 |

(Continued)

OTHER PUBLICATIONS

International Search Report with regard to PCT/RU2014/000426 (dated Mar. 12, 2015).

(Continued)

*Primary Examiner* — Cathleen R Hutchins

(74) *Attorney, Agent, or Firm* — BCF LLP

(57) ABSTRACT

This invention relates to the oil and gas industry and can be used for intensifying the production of well fluids. The present downhole acoustic apparatus comprises an upper head for attachment to a logging cable or coiled tubing, an acoustic emitter and a lower guiding head. The emitter consists of a body with piezoelectric transducers, comprised of piezoceramic discs, arranged perpendicular to the axis of the body. Emitter bodies are formed in the shape of cylinders from a metal with a milled surface and are connected to each other by means of a rubber-plastic filler. This provides an increase in the acoustic power of radiation in a radial direction and makes it possible to treat horizontal and lateral wells.

9 Claims, 1 Drawing Sheet

(56) References Cited

U.S. PATENT DOCUMENTS

| | | | | |
|---|---|---|---|---|
| 3,583,677 | A * | 6/1971 | Phillips | B06B 1/0611 166/177.7 |
| 3,990,512 | A * | 11/1976 | Kuris | E21B 43/003 166/177.1 |
| 4,651,046 | A * | 3/1987 | Ohya | H01L 41/0536 310/328 |
| 7,063,144 | B2 | 6/2006 | Abramov et al. | |
| 2014/0246191 | A1 | 9/2014 | Zolezzi-Garreton | |

FOREIGN PATENT DOCUMENTS

| | | | |
|---|---|---|---|
| RU | 2453677 | C1 | 6/2012 |
| RU | 131062 | U1 | 8/2013 |
| RU | 2521094 | C1 | 6/2014 |
| WO | 2014046560 | A1 | 3/2014 |

OTHER PUBLICATIONS

English Abstract of RU2521094 retrieved on Espacenet on Dec. 7, 2016.

English Abstract of RU2244946 retrieved on Espacenet on Dec. 7, 2016.

Maximov, "Requirements to downhole emitters based on analytical evaluation of radiated acoustic fields", Acoustic Magazine, 2013, vol. 59, No. 3, pp. 301-306.

Gorbachev et al., "Acoustic methods of enhanced oil recovery and oil production intensification", Magazine Oil Industry, 2002, vol. 5, pp. 87-91; http://istina.msu.ru/publications/article/5842848/.

Atamanov et al., "Electroacoustic emitters for restoration of flow rate", Moscow State University of Environmental Engineering, 2007, pp. 1-14.

English Abstract of RU131062 retrieved on Espacenet on Dec. 9, 2016.

* cited by examiner

DOWNHOLE ACOUSTIC DEVICE FOR TREATING THE BOTTOMHOLE REGIONS OF OIL AND GAS RESERVOIRS

The present application is a continuation-in-part of International Patent Application no. PCT/RU2014/000426, filed on Jun. 10, 2014, entitled "DOWNHOLE ACOUSTIC APPARATUS FOR TREATING THE BOTTOMHOLE REGIONS OF OIL AND GAS RESERVOIRS". This application is incorporated by reference herein in its entirety.

FIELD OF THE TECHNOLOGY

The invention relates to devices for acoustic treatment of a formation bottom hole zone.

BACKGROUND OF THE TECHNOLOGY

In the prior art, the downhole acoustic emitter is known (patent RU 2193651 dated Nov. 23, 2001) which is adopted here as a prototype, comprising longitudinally polarized piezoelectric converters made of electrically parallel connected piezoceramic washers, located perpendicular to the axis of the housing to increase the acoustic power in the radial direction. According to the said embodiment, the emitter can be implemented only with the diameter of approximately 100 mm.

The disadvantages of this emitter are:

- impossibility of treating horizontal and side holes due to the absence of tubing in the downhole, which is prohibited by the well safe operation rules;
- impossibility of its operation on the production casing due to the same reason;
- short length of the emitter, that multiple times increasing the treating time of downhole horizontal sections;
- in case of the emitter length increase, it loses its passing ability through the curved sections of the downhole during transition to the side hole or horizontal section.

SUMMARY

The technical object of the invention is to increase the acoustic power of the emitter in the radial direction, the ability to treat horizontal and side holes, the emitter operation in the production casing without lowering tubing (during operation with flexible drill stem or coil tubing), and increase of the radiation area.

The problem of the increase of acoustic energy impact in the radial direction is solved by allocating the acoustic converters perpendicular to the axis of the downhole (a formation is affected by longitudinal waves), using the housing as a radiating surface, and by the shape of the housing radiating surface.

Operation on the production casing (without tubing) in the side and horizontal holes is performed by applying flexible drill stem (or coil tubing with embedded cable) which allows downhole flushing and emergency well killing with the radiating set run in the hole.

The increase of the radiation area results from the capability to connect additional emitters, the quantity of which is limited only by the power of the ultrasonic generator engaged and the logging cable performance (voltage, current rate).

Flexibility and high passability through the curved sections of a downhole is achieved by means of rubber polymeric connection of units and the cone shape of the bottom guiding head of the downhole acoustic device (BAD). Due to its flexibility BAD can be produced of a long length (up to 50 meters) and spooled on a drum like a logging cable (flexible drill stem).

DETAILED DESCRIPTION OF NON-LIMITING EMBODIMENTS

Figure 1:
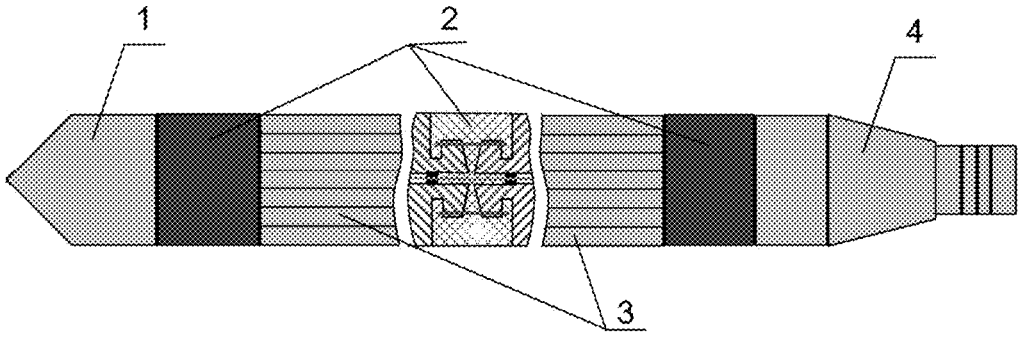
FIG. 1 depicts a downhole acoustic device (BAD).

FIG. 1 is the BAD diagram showing mutual position and connection of the main components, wherein: 1—guiding head, 2—rubber polymeric connections, 3—emitters, 4—attachment node to the carrying logging cable (flexible drill stem, coil tubing).

Acoustic converters made up in the form of separate packages may be of both piezoceramic and magnetostrictive types.

The piezoelectric converter design is described in more detail as a more complicated one. The acoustic converter design with piezoelectric transducers comprises parallel piezoceramic washers of circular section which are installed prestressed.

Figure 2:
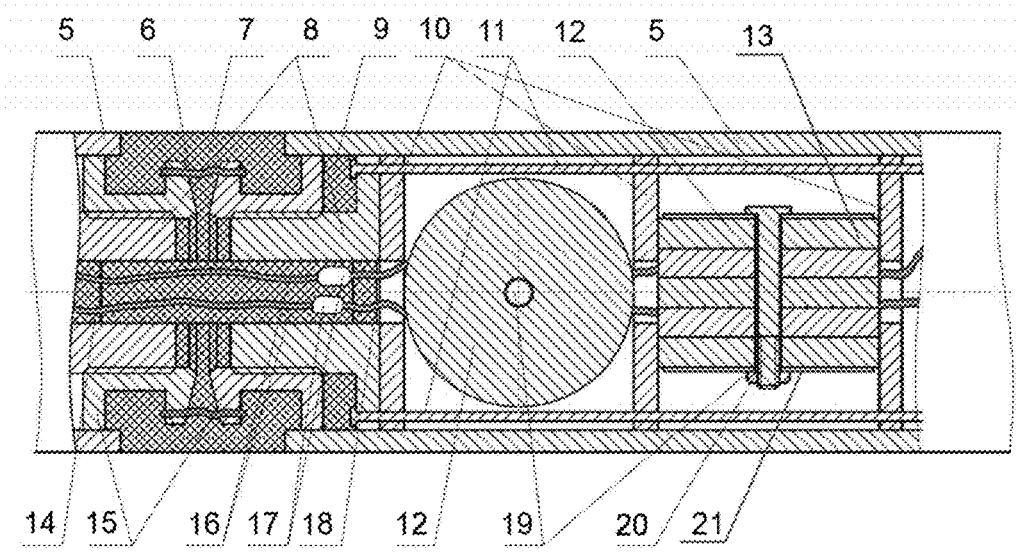
FIG. 2 depicts a cross section of an acoustic converter.

An acoustic converter (FIG. 2) comprises piezopackages 12 which include piezoceramic washers 13 installed inside a housing 5. Adjacent emitters are interconnected by wire cords 6 (4 pcs.) and rubber polymeric filler 7 which withstand a specified breaking tension along the axis. Piezoceramic washers are mated closely to each other using metal spacers 21, screw 19, and nuts 20. Piezopackages 12 are bolted together by tightening screws 11 and bushings 8. Between the piezopackages, as well as between the piezopackages and bushings 8, rubber metal gaskets 10 are placed. The piezopackages are jacketed with a cylindrical casing 5. The casing 5 is fastened and sealed by means of the compression and radial extension of the rubber gasket 9 squeezed by the nuts 15. Additional sealing and fastening of the casings 5 are caused by the rubber polymeric filler 7. The piezopackages are supplied with power by wires 16 which pass through the openings in the elements 8 and 10. The piezopackages are connected to the wires by a parallel circuit. Wires between the emitters are connected using specifically developed connecting nodes 17 and are filled with a rubber polymer. To prevent an ingress of the rubber polymer into the casing 5, rubber plugs 18 are inserted into the cylindrical holes of the couplings 8. The piezopackages parameter control may be performed directly in the course of their operation by processing the signals entering electronics unit.

The prestressing of the piezoceramic washers is produced using a screw 19, a nut 20 and two metal pads 21. By specifying the preliminary stress, the resonance frequency and impedance values for each piezopackage may be adjusted to the required values during assembly.

The said emitter construction allows to conduct (insert through the emitter) an additional wire to energize a geophysical instrument. In this case, the end of the BAD, instead of the guiding head 1 (FIG. 1), is supplied with a head similar to the cable head which allows to couple the BAD with any standard geophysical instrument. This problem is not solved yet in any downhole acoustic emitter known in the art. The use of a geophysical instrument in combination with the BAD allows to monitor downhole parameters in real time and make necessary adjustments of the downhole treatment process. Geophysical instruments comprising temperature, pressure, humidity sensors, noise meters, and etc. also include gamma-ray logging and magnetic collar locator. The latter make it possible to ensure instrument reference to the perforation zone during the BAD lowering into the downhole.

Instead of piezopackages, magnetostrictive packages may be used.

The housing and its components are made of various grades of steel. The emitter operates according to the following scheme. The industrial voltage after conversion (frequency, voltage, current rate, and phase shift) in a ground unit is supplied via the logging cable (flexible drill stem, coil tubing with cable) to the BAD in the downhole. Through the electronic unit, the voltage is supplied to the acoustic emitters (piezopackages or magnetostrictive packages) where along the package axis an acoustic wave is generated to carry mechanical energy in the radial direction, which immediately affects the emitter ambience.

The invention claimed is:

1. A downhole acoustic device, comprising:

a logging cable attachment node, a first polymeric connection coupled to the attachment node;

an emitter housing coupled to the first polymeric connection, the emitter housing being connected to the attachment node by the first polymeric connection;

at least one acoustic emitter disposed in the emitter housing, when the at least one acoustic emitter is in use, the at least one acoustic emitter being arranged to emit radiation in a radial direction perpendicular to a longitudinal axis of the device, all power of the radiation being emitted in the radial direction;

a second polymeric connection coupled to the emitter housing; and a guiding head selectively coupled to the second polymeric connection, the guiding head being connected to the emitter housing by the second polymeric connection, the guiding head being selectively removable to allow connection of at least one alternative geophysical device.

2. The device according to claim 1, wherein the at least one acoustic emitter comprises at least one piezoelectric transducer.

3. The device according to claim 2, wherein the at least one piezoelectric transducer comprises:

a plurality of piezoceramic washers mated closely together;

two metal pads disposed around the plurality of piezoceramic washers;

a screw extending through the plurality of piezoceramic washers; and a nut selectively coupled to the screw, the metals pads, the screw, and the nut securing the plurality of piezoceramic washers.

4. The device according to claim 3, wherein:

the plurality of piezoceramic washers are pre-stressed using the metals pads, the screw, and the nut; and preliminary stress of the plurality of piezoceramic washers is tuned to provide a pre-determined value of at least one of a resonance frequency and an impedance value.

5. The device according to claim 1, wherein the at least one acoustic emitter includes:

a first acoustic emitter oriented to emit radiation perpendicular to the longitudinal axis of the device;

a second acoustic emitter oriented perpendicular to the first acoustic emitter and perpendicular to the longitudinal axis; and both the first acoustic emitter and the second acoustic emitter are disposed in the emitter housing.

6. The device according to claim 5, wherein the first acoustic emitter and the second acoustic emitter are interconnected by wire cords and polymeric filler.

7. The device according to claim 1, wherein the at least one acoustic emitter comprises at least one magnetostrictive emitter, where an acoustic wave generated by the at least one magnetostrictive emitter produces mechanical energy in the radial direction.

8. The device according to claim 1, wherein an overall length of the device is about 50 meters or less.

9. The device according to claim 1, wherein the attachment node is further adapted for connecting to coil tubing containing wires.

* * * * *